US008511389B2

(12) United States Patent
Fenton

(10) Patent No.: US 8,511,389 B2
(45) Date of Patent: Aug. 20, 2013

(54) SYSTEM AND METHOD FOR INDUCTIVE SIGNAL AND POWER TRANSFER FROM ROV TO IN RISER TOOLS

(75) Inventor: Stephen P Fenton, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 416 days.

(21) Appl. No.: 12/908,123

(22) Filed: Oct. 20, 2010

(65) Prior Publication Data

US 2012/0097383 A1 Apr. 26, 2012

(51) Int. Cl.
*E21B 34/04* (2006.01)
*E21B 47/00* (2012.01)

(52) U.S. Cl.
USPC ..... 166/368; 166/341; 166/352; 166/250.01; 166/66.5; 340/854.8

(58) Field of Classification Search
USPC ..... 166/368, 338, 341, 342, 348, 351, 166/352, 250.01, 373, 65.1, 66, 66.5, 66.6; 340/853.1–853.3, 854.8; 702/6, 7
See application file for complete search history.

(56) References Cited

U.S. PATENT DOCUMENTS

| | | | | |
|---|---|---|---|---|
| 4,027,286 | A * | 5/1977 | Marosko | 340/13.33 |
| 6,343,649 | B1 * | 2/2002 | Beck et al. | 166/250.01 |
| 6,343,654 | B1 * | 2/2002 | Brammer | 166/338 |
| 6,359,569 | B2 * | 3/2002 | Beck et al. | 340/856.3 |
| 6,481,505 | B2 * | 11/2002 | Beck et al. | 166/387 |
| 6,497,280 | B2 * | 12/2002 | Beck et al. | 166/250.07 |
| 6,513,596 | B2 * | 2/2003 | Wester | 166/336 |
| 6,588,505 | B2 * | 7/2003 | Beck et al. | 166/250.17 |
| 6,725,924 | B2 * | 4/2004 | Davidson et al. | 166/250.01 |
| 7,000,693 | B2 * | 2/2006 | Powell | 166/66.4 |
| 7,011,152 | B2 * | 3/2006 | Soelvik | 166/65.1 |
| 7,240,736 | B2 | 7/2007 | Fenton et al. | |
| 7,261,162 | B2 * | 8/2007 | Deans et al. | 166/336 |
| 7,318,480 | B2 * | 1/2008 | Hosie et al. | 166/367 |
| 7,328,741 | B2 * | 2/2008 | Allen et al. | 166/64 |
| 7,336,199 | B2 * | 2/2008 | Lasater et al. | 340/854.8 |
| 7,513,308 | B2 * | 4/2009 | Hosie et al. | 166/338 |
| RE41,173 | E * | 3/2010 | Baggs | 340/853.7 |
| 7,735,555 | B2 * | 6/2010 | Patel et al. | 166/278 |
| 7,762,338 | B2 * | 7/2010 | Fenton et al. | 166/348 |
| 7,921,916 | B2 * | 4/2011 | Lovell et al. | 166/336 |
| 8,122,963 | B2 * | 2/2012 | Davis | 166/336 |
| 2006/0065401 | A1 * | 3/2006 | Allen et al. | 166/345 |
| 2007/0039738 | A1 * | 2/2007 | Fenton et al. | 166/368 |
| 2007/0246220 | A1 * | 10/2007 | Fenton | 166/344 |
| 2011/0025526 | A1 * | 2/2011 | Simpson et al. | 340/853.7 |

OTHER PUBLICATIONS

GB search Report issued Nov. 14, 2011 in corresponding Application No. GB1117960.3.
Christie et al., "Subsea Solutions", Oilfield Review (Winter 1999-2000), pp. 1-19.

* cited by examiner

*Primary Examiner* — Matthew Buck
(74) *Attorney, Agent, or Firm* — Bracewell & Giuliani LLP

(57) ABSTRACT

A subsea wellhead assembly having a completion landing string inside a drilling riser is described herein and comprises a power source for generating an alternating electrical current; a connector for connecting the power source to a receptacle in the subsea well assembly; a first inductor electrically connected to the power source through the connector; a subsea control module delivering power and control signals to the subsea well assembly; and a second inductor spaced from the first inductor, and located in the subsea control module, the second inductor positioned so that an EMF is produced on the second inductor when the alternating electrical current is passed through the first inductor to thereby generate an alternating current signal on the second inductor.

17 Claims, 4 Drawing Sheets

SYSTEM AND METHOD FOR INDUCTIVE SIGNAL AND POWER TRANSFER FROM ROV TO IN RISER TOOLS

BACKGROUND OF THE INVENTION

1. Field of the Invention

This invention relates in general to offshore drilling, and in particular to equipment and methods for providing electrical communication between a surface drilling platform or an ROV using an umbilical.

2. Prior Art

Control of subsea equipment is typically effected from the surface mounted control station via an umbilical. The umbilical typically carries hydraulic power and may include electrical power, and communication for control and monitoring of equipment in or on the well. When completing a subsea well for subsea production, a riser extends from a surface vessel and attaches to the subsea well. A tubing hanger is lowered on a conduit (typically termed a landing string) through the riser and landed in the tubing spool or wellhead assembly. A tubing hanger running tool, which is connected to the upper end of the tubing hanger sets the seal and locking member of landing of the tubing hanger in the wellhead or similar apparatus. The umbilical extends from the running tool alongside the conduit inside the riser to the surface platform. A lower marine riser package ("LMRP") and subsea blowout preventer ("BOP") are typically utilized for safety and pressure control. In arrangements in which the BOP provides the main basis for pressure control, the BOP typically closes in on and engages the outer surface of the landing string at a location above the tubing hanger running tool.

With a conventional subsea BOP rams may close or shear on the running tool at a point below the attachment of the umbilical to the landing string. BOP rams cannot seal around a conduit if the umbilical is alongside without damaging the umbilical, so the umbilical is terminated and the individual function lines to the tubing hanger running tool are ported through a "BOP spanner joint" that enables space out of the landing string and thereby enables closure of the BOP rams without damage to the control functions. This arrangement presents an obstacle to the use of a surface BOP for subsea completion operations as the spanner joint must be located at the surface location, resulting in a variable height depending on water depth that the umbilical must accommodate. Generally, also there is an inherent risk of damage to the umbilical during running and operation when used within subsea drilling risers. For this reason, a means of providing power and control external to the drilling riser system is attractive

BRIEF DESCRIPTION OF THE DRAWINGS

So that the manner in which the features and advantages of the invention, as well as others, which will become apparent, may be understood in more detail, a more particular description of the invention briefly summarized above may be had by reference to the embodiments thereof, which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

Figure 1:
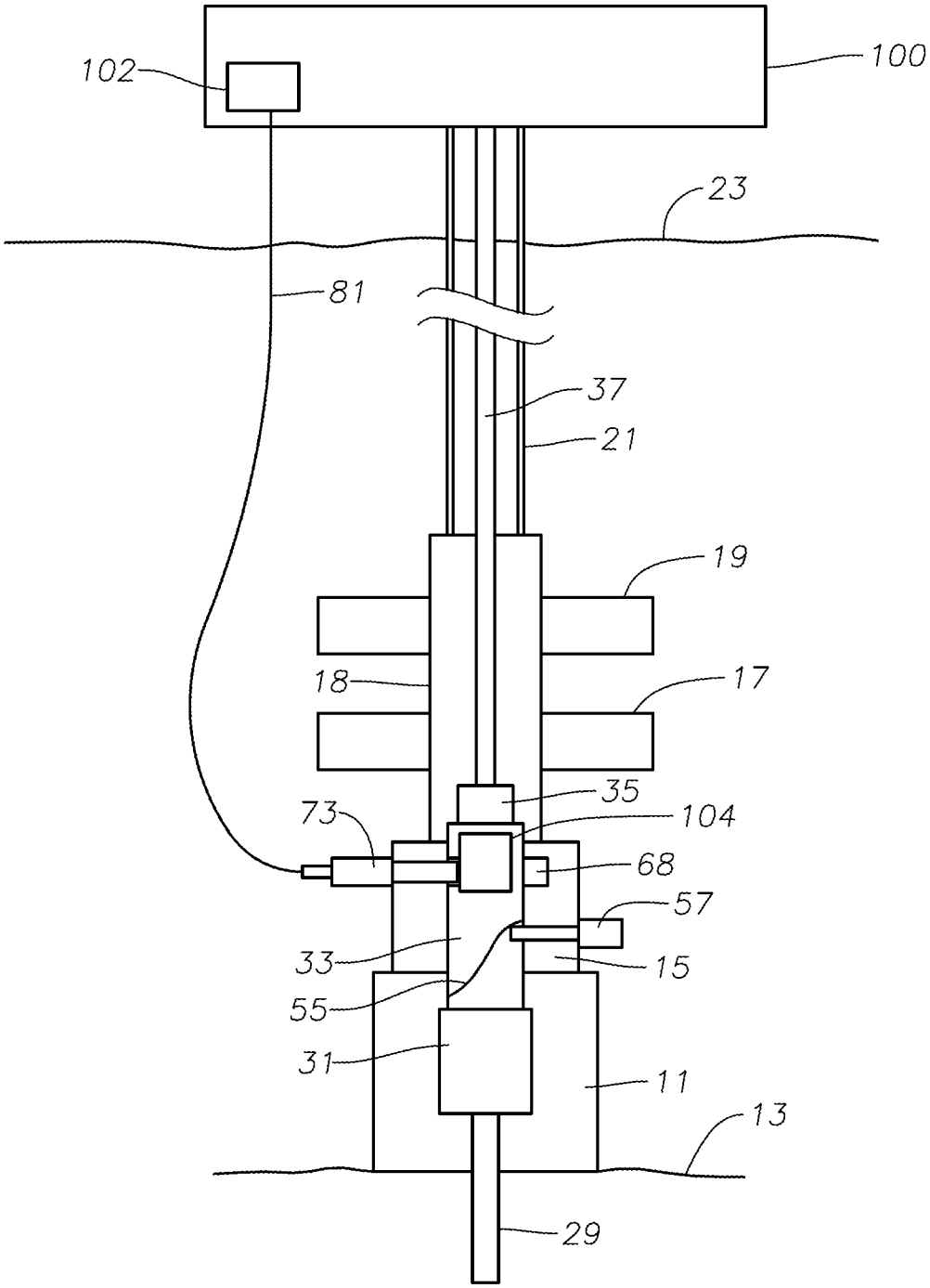
FIG. 1 is a schematic view of a tubing hanger being run through a riser system and having an umbilical attached between a surface mounted control station and a BOP orientation spool according to an embodiment of the invention.

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

A subsea well assembly is described with reference to FIG. I. where a wellhead 11 is schematically shown located at sea floor 13. Wellhead 11 may be a wellhead housing, a tubing hanger spool, or a Christmas tree of a type that supports a tubing hanger within. An adapter 15 connects wellhead 11 to a subsea blow-out preventer (BOP) 18, typically having a set of pipe rams 17. Pipe rams 17 seals around pipe of a designated size range but will not fully close access to the well if no pipe is present. The subsea BOP 18 also includes a set of shear rams 19 in the preferred embodiment. Shear rams 19 are used to completely close access to the well in an event of an emergency, and will cut any lines or pipe within the well bore. Pipe rams 17, 19 may be controlled by, e.g., an umbilical 81 leading to the surface platform 100 and control station (not shown).

A riser 21 extends from BOP system 18 upward, and uses connections between the individual riser pipes to achieve the necessary length. Alternatively, riser 21 may utilize casing with threaded ends that are secured together, the casing being typically smaller in diameter than a conventional drilling riser to accommodate a surface BOP. Riser 21 extends upward past sea level 23 to be supported by a tensioner (not shown) of the platform 100. Platform 100 may be of a variety of types and will have a derrick and draw works for drilling and completion operations, and may also have a local control station 102 located thereon for provision of power and control of the subsea equipment.

FIG. 1 illustrates a string of production tubing 29 lowered into the well below wellhead 11. A tubing hanger 31, secured to the upper end of production tubing 29, lands in wellhead 11 in a conventional manner. A conventional tubing hanger running tool 33 releasably secures to tubing hanger 31 for running and locking it to wellhead 11, and for setting a seal between tubing hanger 31 and the inner diameter of wellhead 11. Tubing hanger landing string 37 which may be tubing or drill pipe and typically includes a quick disconnect member 35 at the interface to the tubing hanger running tool 33 located below rams 17, 19 of the BOP 18. Disconnect member 35 allows running tool 33 and tubing hanger 31 to be disconnected from conduit 37 in the event of an emergency. Rams 17 will be able to close and seal on landing string 37, and rams 19 are configured to shear landing string 37 in an extreme emergency.

Figure 3:
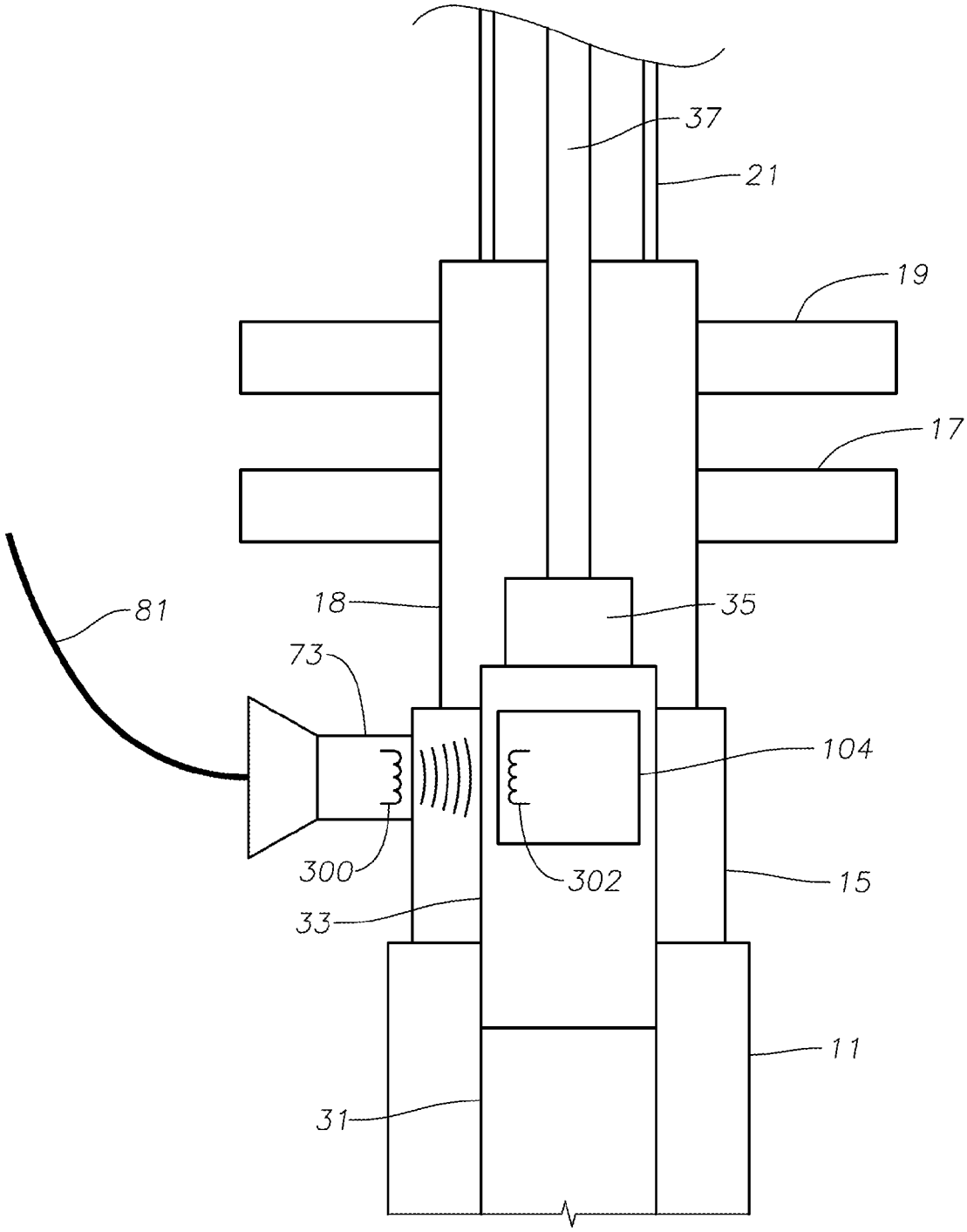
FIG. 3 is a block diagram of the connection between an umbilical and a power pack located on a tool string according to an embodiment of the invention.

An umbilical line 81 may extend alongside, but is not within riser 21, and supplies electrical power to running tool 33 via a power pack 104. Umbilical line 81 comprises, within a jacket, a plurality of conductive wires for connecting to the housing to control the various functions of running tool 33 and a reciprocal connector 73. Reciprocal connector 73 plugs into an engagement member of the adapter 15, or alternatively into a similar engagement member that may be integrated within the BOP system 18, and comprises an inductor 300 that transfers inductive power to a second inductor 302 mounted within or adjacent to power pack 104 associated with the tubing hanger running tool, as indicated in FIG. 3. The electrical functions may include sensing various positions of the running tool 33 and feedback of fluid pressures during testing, but principally transmit power to the power pack to generate hydraulic power via pump 410 (FIG.4) in order to effect operation of the running tool itself and any other functions that may be incorporated within the landing string system. As is routinely carried out, running tool 33 may have an orientation cam or slot 55 that is positioned to contact an orientation pin 57 mounted to the sidewall of adapter 15 below pipe rams 17. As cam slot 55 contacts orientation pin 57 while running tool 33 is being lowered, running tool 33 will rotate to a desired orientation relative to wellhead 11. Preferably, orientation pin 57 is retractable so that the orientation pin 57 will not protrude into the bore of adapter 15 during normal drilling operations. Various other means are practiced to achieve the same result, namely to dispose the tubing hanger in a known orientation. This register is then used to orientate the external power receptacle 73 relative to the mating inductive power connection 402 within the power pack 104 located above the tubing hanger running tool 33.

Figure 4:
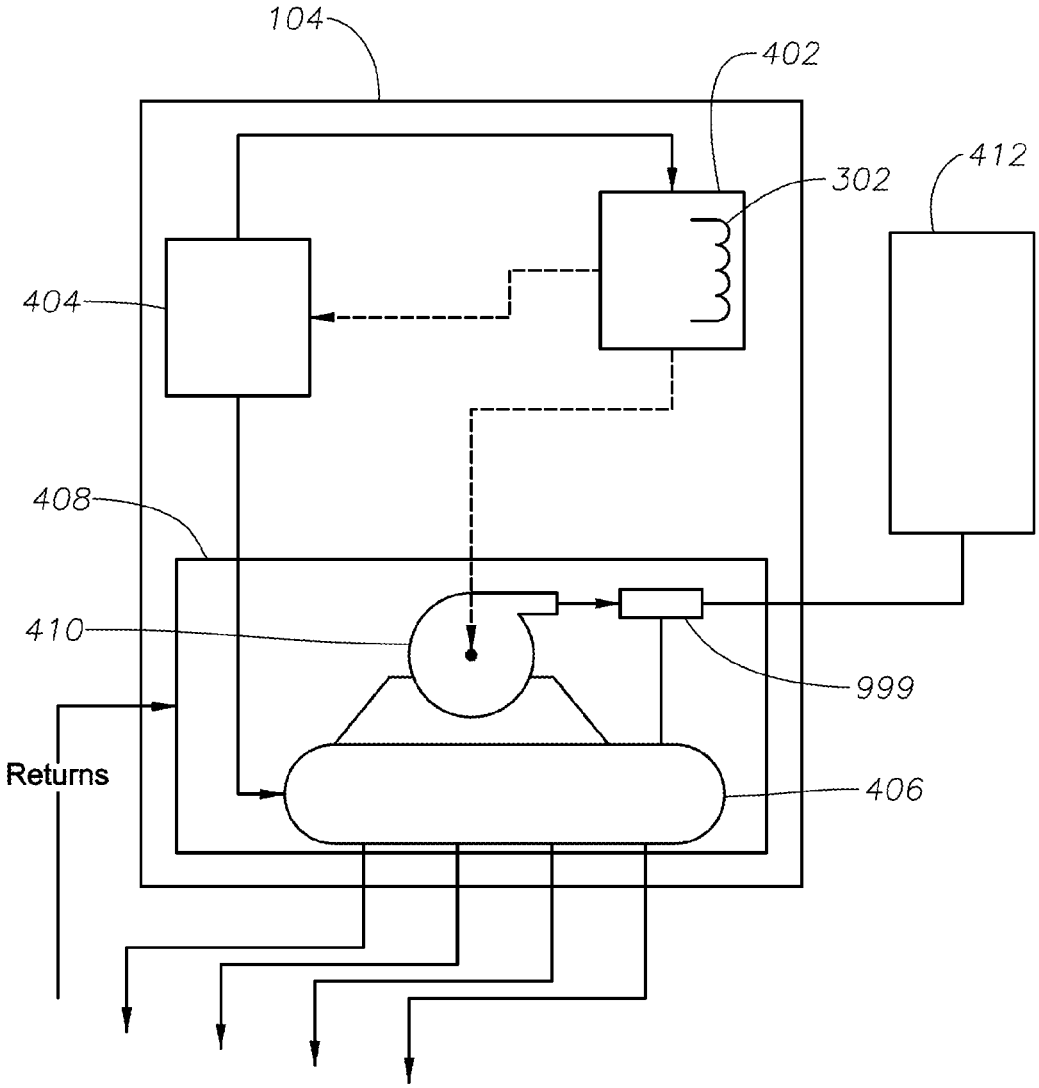
FIG. 4 is a block diagram of a subsea control module that would be mounted on the tubing hanger system landing string, having an inductive receiver and power pack integrated therein according to an embodiment of the invention.

Subsea control module 104 is shown in FIGS. 3 and 4 and includes electrical and hydraulic controls that preferably include a hydraulic accumulator 408 that supplies pressurized hydraulic fluid upon receipt of a signal through umbilical 81. The function of subsea control module 104 is to effect operation of the tubing hanger-running tool and any other operable devices required to be controlled by the landing string system by directing hydraulic fluid stored in fluid reservoir 408 and emergency reservoir 412. As can be seen in FIG. 3, subsea control module 104 connects inductively to an umbilical 81 that is located on the exterior of riser 21, rather than an interior umbilical. Umbilical 81 extends up to a control station 102 mounted on platform 100.

As shown in FIG, 4, subsea control module 104 comprises power pack 402, subsea electronics module (SEM) 404, fluid reservoir 408, pump 410, directional, control valve module (DCV) 406, and emergency reservoir 412. The power pack 402 comprises an inductor 302 and associated electronics, e.g., an AC/DC converter. The inductor 302 together with the inductor 300 of the reciprocal connector 73 combine to create essentially a transformer. As one skilled in the art will appreciate, transformers can be used to pass an AC voltage from one circuit to another, to thereby act as a power source for the second circuit. In this instance, the inductor 300 -inductor 302 combination pass power along with e.g., as bi-directional communications signal between the control station 102 to the subsea control module 104. As mentioned, the power pack may also include an AC/DC converter and DC/AC converter or other electronics to convert some or the entire AC signal to a DC signal and vice versa for use by some modules and to enable bidirectional communication, For example, a rectifier (not shown) might be used to convert the AC signal to a DC signal, and an inverter (not shown) could be used to convert a DC signal from the SEM to an AC signal for transmission through the inductor 300-inductor 302 combination.

The SEM 404 receives a signal from the power pack 402 to power the functions thereof and may further convert the signal to a digital signal for use by some of the electronic components of the SEM, e.g., microcontrollers and other digital devices. In, this way, the inductor 300-inductor 302 combination allows the umbilical to transmit both power and control signals from the control station 102 to the subsea well assembly from outside of the drilling riser 21. SEM 404 monitors and directs control of the subsea equipment including all sensors, valves and external pumps and DVC modules, as is conventionally known in the art. An exemplary SEM embodiment of SEM 404 is disclosed in RE 41,173, incorporated herein by reference. As described therein, the SEM 404 may be connected to various pressure, temperature and other sensors in the well bore to monitor the function of the well. In such embodiments, SEM may include, e.g., a modem so as to propagate the signals from the sensors to the inductor 300-inductor 302 combination for communication to the control station 102.

As can be seen, DCVs 406 operate at the direction of SEM 404 to output hydraulic fluid stored in fluid reservoir 408 within the subsea well assembly using pump 410 to actuate flow. Finally, an emergency reservoir 412 may be employed to provide hydraulic fluid power in case of a depletion of fluid in reservoir 408 from, for example, a leak in the reservoir or any lines or valves in the subsea well assembly. Activation of the emergency reservoir 412 operates a conventional shuttle valve 999 to crossover the input hydraulic supply to the DCV's 406 from the emergency reservoir, by-passing the normally pump activated hydraulic supply from the reservoir, and enabling the choke and kill pressure to charge the accumulated emergency reservoir supply pressure to a prescribed level. As one skilled in the art will appreciate, however, there are other control circuits that may be applied to effect change over of supply to the emergency reservoir and such embodiments are within the scope of the disclosure.

The operation of the embodiment of FIG. I will now be described. When tubing hanger 31 is engaged in the wellhead, an ROV (not shown) engages orientation pin 57 to cause it to extend. Orientation pin 57 engages cam slot 55 and rotates running tool 33 to the desired alignment as running tool 33 moves downward. The ROV (not shown) provides the means to stroke orientation pin 57, the means being either electrical, hydraulic or torque. Other known means may also be employed to effect orientation of the tubing hanger on landing, such as a similar ROV pin to running tool cam slot, or direct means via it cam located below the tubing hanger in the tubing spool or tree.

ROV connects the umbilical to reciprocal connector 73. This causes connector 73 to advance into engagement with receptacle 59. An operator at the control station then provides power to the umbilical in order to transfer power and control signals inductively to receiver 402 in the power pack 104 to the SEM 404 (control signals) and pump 410, thereby delivering hydraulic pressure to the various lines via the SCM to cause running tool 33 to set tubing hanger 31.

The operator may also sense various functions, such as pressures or positions of components, through umbilical 81. In such embodiments, the inductor 300-inductor 302 combination may act as a bi-directional communications link between the control station 102 and the well head assembly. Typically, the operator will test the seal of tubing hanger 31 to determine, whether the seal has properly set. This may be done by applying pressure to the fluid in the annulus in riser 21 with BOP 18 closed around conduit 37. Alternately, testing may be done by utilizing a remote operated vehicle ("ROV" not shown in FIG. 4) to engage a test port 68 located in the sidewall of adapter 15. In that event, pipe rams 17 would be actuated to close around disconnect member 35 to confine the hydraulic pressure to a chamber between the seal of tubing, hanger 31 and pipe rams 17. The ROV supplies the hydraulic pressure through an internal pressurized supply of hydraulic fluid. In such embodiments, the pressure being exerted into such chamber could be monitored through umbilical 81.

Figure 2:
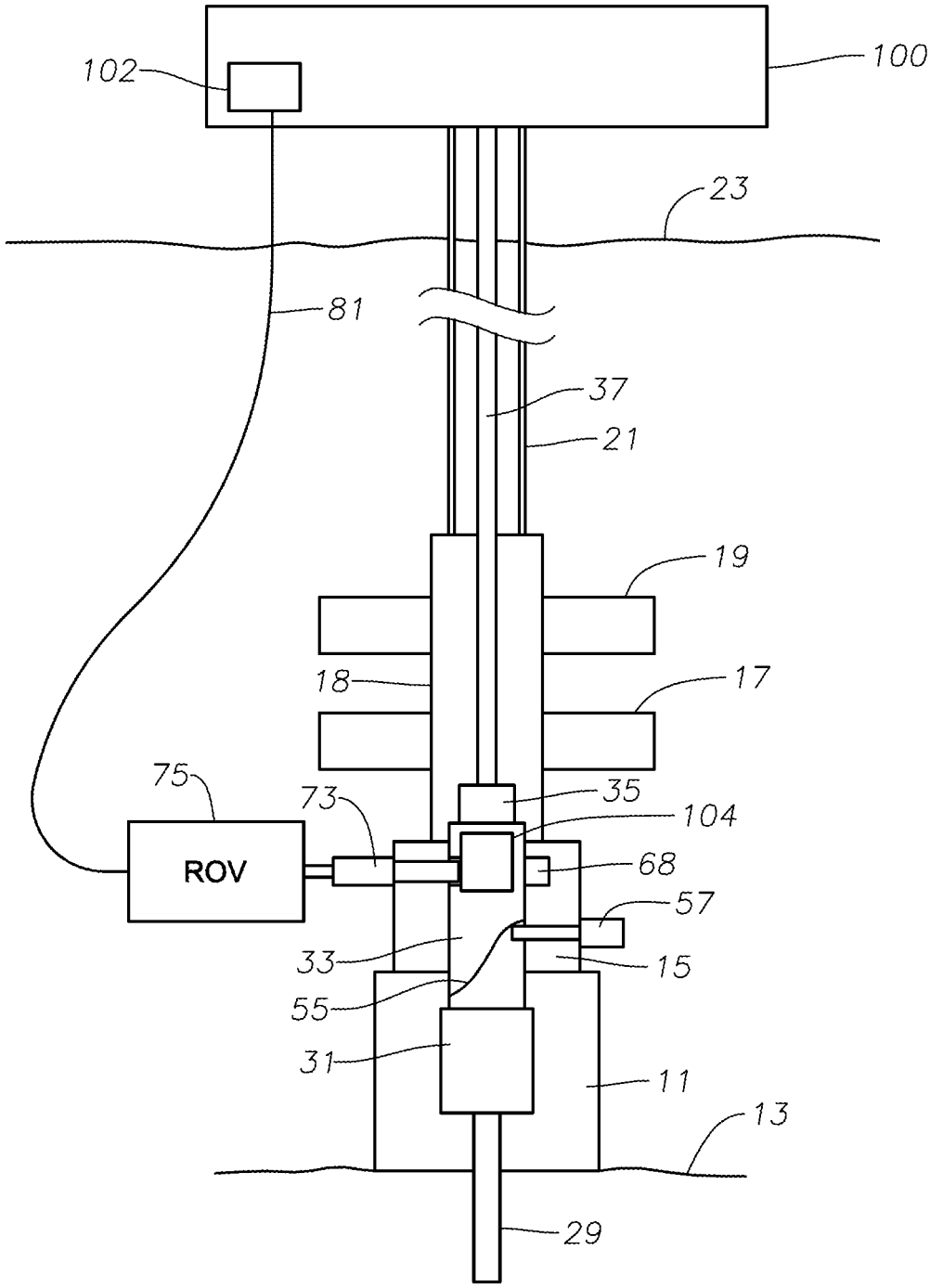
FIG. 2 to is a schematic view of a tubing hanger being run through a riser system and having power and control signals conveyed to the BOP orientation spool from an ROV Controls Interface utilizing the ROV's umbilical in lieu of a dedicated external umbilical, according to another embodiment of the invention.

In the embodiment of FIG. 2, a reciprocal connector 73 is mounted to adapter 15. Reciprocal connector 73 is the same as connector 73 of FIG. 14, except that rather than being connected to a control station as in FIG. 1, it has a port that is engaged by an ROV 75. ROV 75 is a conventional type that is connected to the surface via, e.g., an umbilical 81 that connects to the control station 102 a wireless communications control, etc. ROV 75 has a power source within it that is capable of supplying AC power and a modulator (not shown) disposed therein capable of modulating control signals onto the AC current waveform. For example, the ROV 75 may have a DC battery connected to an inductor for supplying power to the subsea well assembly. Preferably, the pressure source will comprise an accumulator having a sufficient volume to stroke orientation pin 57 and reciprocal connector 73 and optionally to test the seal of tubing hanger 31.

In the operation of this embodiment, ROV 75 first connects to orientation pin 57 and extends it, then is moved to reciprocal connector 73. After running tool 33 has landed tubing banger 31, ROY 75 strokes reciprocal connector 73 into engagement with running tool 33 and thereby transfers electrical power to the power pack 104 to set tubing hanger 31 and operate any other landing string functions. Then ROV 75 moves over to test port 68 for providing hydraulic fluid pressure for test purposes in the same manner as described in connection with FIG. 4.

In each of the embodiments described above, the power and hydraulic line or control line is not exposed well pressures during completion operations. These embodiments help to reduce the risks of damaging and disabling the umbilical line from the surface vessel to the running tool, or developing a leak at the termination point within the riser when employing either or both of a subsea or surface BOP and associated "spanner joints" as previously described. The embodiments in FIGS. 1-3 also help to reduce the risks of the issues associated with conventional assemblies having the control lines extending through the riser while in fluid communication with the bore of the wellhead assembly.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

What is claimed is:

1. A subsea wellhead assembly having a completion landing string inside a drilling riser and comprising:

a power source for generating an alternating electrical current;

a connector for connecting the power source to a receptacle in the subsea wellhead assembly:

a first inductor electrically connected to the power source through the connector;

a subsea control module delivering power and control signals to the subsea well assembly;

a second inductor spaced from the first inductor, and located in the subsea control module, the second inductor positioned so that an electromotive force (EMF) is produced on the second inductor when the alternating electrical current is passed through the first inductor to thereby generate an alternating current signa1 on the second inductor;

a power pack having the second inductor disposed therein, the power pack adapted to receive the alternating current signal from the second inductor and to convert part of the alternating current signal generated thereon into a direct current signal; and a subsea electronics module, powered by the power pack and receiving the direct current signal, the subsea electronics module monitoring various measurements in the well head assembly, including temperatures and pressures of various hydraulic lines and actuating directional control valves to control a flow of hydraulic fluid to functions on the well head assembly and/or landing string.

2. A well-head assembly of claim 1, wherein the subsea control module further includes:

a fluid reservoir, connected to the directional control valves and a pump, the pump being driven by the electrical supply and supplying hydraulic fluid to the well head assembly or landing string from the fluid reservoir.

3. A well-head assembly of claim 2, wherein the subsea electronics module controls the pump to supply hydraulic fluid to the well-head assembly and/or landing string.

4. A well head assembly of claim 3, wherein the well head assembly further comprises a emergency reservoir of hydraulic fluid, the emergency reservoir including a valve that is opened when pressure readings by the subsea electronics module indicate pressure has dropped in at least one of the hydraulic lines.

5. A well head assembly of claim 4, wherein a choke and kill line pressure is used to activate the emergency reservoir.

6. A subsea wellhead assembly having a completion landing string inside a drilling riser and comprising:

a power source for generating an alternating electrical current:

connector for connecting the power source to a receptacle in the subsea wellhead assembly:

a first inductor electricity connected to the power source through the connector;

subsea control module delivering power and control signals to the subsea well-head assembly; and a power pack comprising a second inductor, the second inductor spaced from the first inductor and located in the subsea control module, the second inductor positioned so that an electromotive force (EMF) is produced on the second inductor when the alternating electrical current is passed through the first inductor to thereby generate an alternating current signal on the second inductor, the power pack adapted to receive the alternating current signal from the second inductor;

wherein the subsea well-head assembly is configured so that when a surface control signal is modulated onto the current supplied to the first inductor, the power pack demodulates the alternating current signal produced on the second inductor to supply a subsea electronics module with the surface control signal.

7. A well-head assembly of claim 6, further comprising:

an adapter disposed on the well-head, around a tubing hanger, the adapter including a tubing hanger orientation pin, wherein the receptacle is located, in the adapter, and is aligned to the tubing hanger orientation pin to align the receptacle for the first inductor with the second inductor mounted on a tubing hanger running tool.

8. A subsea well-head assembly having, a completion landing string inside a drilling riser and comprising:

a power source for generating an alternating electrical current;

a connector for connecting the power source to a receptacle in the subsea well assembly;

a first inductor electrically connected to the power source through the connector;

a subsea control module delivering power to the subsea well assembly; and a power pack composing a second inductor, the second inductor spaced from the first inductor, and located in the subsea control module, the second inductor positioned so that an electromotive (EMF) is produced on the second inductor When the alternating electrical current is passed through the first inductor to thereby generate an alternating current signal on the second inductor, the power pack adapted to receive the alternating current signal from the second inductor;

wherein the subsea well-head assembly is configured so that when a surface control signal is modulated onto alternating electrical current supplied to the first inductor, the power pack demodulates the alternating current signal produced on the second inductor to supply a subsea electronics module powered by the power pack with the surface control signal.

9. A well-head assembly of claim 8, further comprising;

an adapter disposed on the well-head, around a tubing, hanger, the adapter including a tubing hanger orientation pin, wherein the receptacle is located in the adapter, and is aligned to the tubing hanger orientation pin to align the receptacle for the first inductor with the second inductor mounted on a tubing hanger running tool.

10. A subsea well-head assembly having a completion landing string inside a drilling riser and comprising:

power source for generating an alternating electrical current:

a connector for connecting the power source to a receptacle in the subsea well-head assembly:

a first inductor electrically connected to the power source through the connector:

a subsea control module delivering power to an underground well assembly:

a power pack having a second inductor disposed therein, the second inductor spaced from the first inductor and located in the subsea control module, the second inductor positioned so that an electromotive force (EMF) is produced on the second inductor when the alternating electrical current is passed through the first inductor to thereby generate an alternating current signal on the second inductor, the power pack adapted to receive the alternating current signal from the second inductor and to convert alternating current signal generated thereon into a direct current signal; and a subsea electronics module, powered by the power pack and receiving the direct current signal, the subsea electronics module monitoring various measurements in the well head assembly, including temperatures and pressures of various hydraulic lines and actuating directional control valves to control a flow of hydraulic fluid through the lines and valves of the well head assembly.

11. A well-head assembly of claim 10, wherein he subsea control module further includes:

a fluid reservoir, connected to the directional control valves and a pump it being driven by the electrical supply and supplying hydraulic fluid to the well head assembly and/or landing string from the fluid reservoir.

12. A well-head assembly of claim 11, wherein the subsea electronics module controls the pump to supply hydraulic fluid to the well-head assembly andlor landing string.

13. A well head assembly of claim 12, wherein the well head assembly further comprises a emergency reservoir of hydraulic fluid, the emergency reservoir including a valve that is open when pressure readings by the subsea electronics module indicate pressure has dropped in at least one of the hydraulic lines.

14. A well-head assembly of claim 13, wherein a choke and kill line pressure is used to activate the emergency reservoir, and the emergency reservoir is activated.

15. A well-head assembly of claim 10 wherein the power source is an umbilical connected to a control station on a well platform, the umbilical providing power and control signals to the subsea control module.

16. A well-head assembly of claim 15, wherein the control signals are communicated to the subsea control module by modulating the control signal on an alternating current signal supplied to the second inductor.

17. A well head assembly of claim 16, wherein an ROV modulates the control signal onto the current supplied to the first inductor and the power pack demodulates the alternating current signal produced on the second inductor to supply the subsea electronics module with the control signal.

* * * * *